US006247195B1

(12) United States Patent
O'Brien et al.

(10) Patent No.: US 6,247,195 B1
(45) **Date of Patent: *Jun. 19, 2001**

(54) LOW MAINTENANCE LONG SERVICE LIFE MARITIME HEAD

(75) Inventors: Owen G. O'Brien, San Diego; Paul C. Cassani, El Cajon; William A. Hall, Chula Vista, all of CA (US); John L. Cuzzocrea, Lorton, VA (US); Pasquale J. Russo, San Marcos; Douglas P. Tibbitts, El Cajon, both of CA (US)

(73) Assignee: Corrosion Engineering Services, Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/300,189

(22) Filed: Apr. 27, 1999

(51) Int. Cl.[7] ..... A47K 4/00; B63B 29/14

(52) U.S. Cl. ..... 4/663; 4/664; 52/265; 52/268; 114/71

(58) Field of Search ..... 4/662–664; 114/71, 114/78; 52/265, 268, 269, 318

(56) References Cited

U.S. PATENT DOCUMENTS

| | | | | |
|---|---|---|---|---|
| 2,087,121 | * | 7/1937 | Samelow | 4/663 X |
| 2,168,949 | * | 8/1939 | Bentz et al. | 52/265 X |
| 2,817,846 | * | 12/1957 | Stift | 4/664 |
| 3,110,907 | * | 11/1963 | King | 4/663 X |
| 3,521,418 | * | 7/1970 | Bartoloni | 52/318 |
| 3,651,776 | * | 3/1972 | Hopeman, Jr. et al. | 114/71 |
| 3,813,836 | * | 6/1974 | Dielman | 4/664 X |
| 5,339,589 | * | 8/1994 | Thrower | 52/318 |
| 5,438,714 | * | 8/1995 | Shaw | 4/664 |

FOREIGN PATENT DOCUMENTS

| | | | | |
|---|---|---|---|---|
| 769350 | * | 10/1967 | (CA) | 52/318 |
| 731020 | * | 9/1996 | (EP) . | |
| 1180566 | * | 2/1970 | (GB) | 4/664 |
| 2088292 | * | 6/1982 | (GB) | 114/71 |
| 323937 | * | 5/1970 | (SE) | 4/664 |

* cited by examiner

*Primary Examiner*—David J. Walczak
*Assistant Examiner*—Kathleen J. Prunner

(57) ABSTRACT

A head structure is disclosed which includes a novel deck, bulkhead and overhead coating which prevents moisture, especially corrosive sea water, or salt atmosphere from reaching the underlying deck, bulkhead or overhead even if the surface of the coating is damaged or penetrated. The coating provides an attractive and highly durable surface which is easily cleaned and resists staining or discoloring. The novel coating in connection with the unique head design allows a head to be easily and rapidly cleaned and maintained a daily basis by simple wash-and wipe techniques requiring minimal crew involvement time. This permits crew members to be able to devote more of their time to education and productive endeavors rather than to maintenance. The head has a deck, bulkhead and an overhead, most or all of which are susceptible to corrosion in the salt water environment. The structure of the head includes one or more lavatory fixtures (especially commodes or basins) mounted on the bulkhead, and a coating adhered to and covering the corrosion-susceptible deck, bulkhead or overhead metal surface, the coating including a porcelain, ceramic or terrazzo layer disposed adjacent to but spaced apart from the metal surface, a moisture-impervious membrane disposed between the porcelain, ceramic or terrazzo layer and the metal surface, and adhesive bonding the porcelain, ceramic or terrazzo layer to the membrane and the membrane to the metal surface.

16 Claims, 3 Drawing Sheets

LOW MAINTENANCE LONG SERVICE LIFE MARITIME HEAD

BACKGROUND OF THE INVENTION

1. Field of the Invention

The invention herein relates to the structure of heads (lavatories) on seagoing vessels, maritime harbor vessels and sea-positioned structures. More particularly it relates to a head concept which provides heads which are designed to be readily maintainable, have long service life, and be attractive and functional for a vessel's crew members who use them.

2. Description of the Prior Art

Ocean going ships, such as Navy ships or commercial freighters, operate in environments which can cause rapid corrosion and deterioration of a ship's structure. Salt water and water vapor as well as high humidity rapidly attack steel structures such as decks, bulkheads and fittings. Over the years, navies and commercial shipping lines have used many commercial types of coatings in efforts to prevent ships'steel structures from corrosion in the salt atmosphere. Such coatings have, however, only been moderately satisfactory, in that they are often permeable to corrosive vapors, are easily worn away by foot traffic, collect and retain dirt or become stained, and are easily punctured or torn, thus exposing the underlying steel structure to the corrosion that the coating was intended to prevent. All of this leads to short service lives of heads, and usually quires that they be rehabilitated every 1–2 years and fully replaced every 4–5 years. This of course represents significant expense and head downtime for the ship owner or operator.

Current head designs and materials also require extensive daily maintenance. Even with diligent attention by cleaning personnel, dirt and grime become lodged in crevices, deck coating maintenance is difficult and time-consuming because of deck-mounted stanchions for commodes, basins, and partitions, and coatings resist cleaning by simple soap-and-water washes. Consequently an excessive amount of time is required for cleaning personnel to maintain heads in a clean and aesthetically acceptable manner. Not only does this tie up crew members in a duty which many consider to be unpleasant, but it also takes away time when such crew members could be working at other duties or obtaining training to improve other skills.

It would therefore be advantageous to have a head design and head materials which would permit heads to be maintained in a simple and relatively easy manner and to retain their cleanliness and attractiveness over a prolonged period with minimal maintenance, and which would substantially extend head service life such that refurbishment and replacement would not be needed for a significant number of years. Most importantly, in addition, such design and materials, especially coatings, must be such that underlying steel structures such as decks and bulkheads will be secured from contact with and corrosion by the corrosive atmosphere found at sea. Further, such head design and coatings should be applicable to a wide variety of seagoing or sea-positioned structures or vessels, including all kinds of seagoing vessels and maritime harbor vessels as well as sea-positioned structures such as oil well drilling rigs, offshore loading facilities, crewed shore-side or offshore light stations, and the like.

SUMMARY OF THE INVENTION

We have now invented a unique and highly efficient head structure which includes a novel deck and bulkhead coating which prevents moisture, especially corrosive sea water, or salt atmosphere from reaching the underlying deck or bulkhead metal even if the surface of the coating is damaged or penetrated. In addition, the coating provides an attractive and highly durable surface which is easily cleaned and resists staining or discoloring. The novel coating in connection with the unique head design allows a head to be easily and rapidly cleaned and maintained on a daily basis by simple wash-and wipe techniques requiring minimal crew involvement time. This permits crew members to be able to devote more of their time to education and productive endeavors rather than to maintenance.

The heads of this invention find utility when incorporated into seagoing vessels 82, maritime harbor vessels, and sea-positioned structures 84 such as oil drilling rigs or seabed mining rigs, especially where the crews thereof include both men and women, such as in many current ships of the U.S. Navy.

More specifically, the head structure will include one or more commodes, showers stalls, wash basins, utility basins, urinals, or other lavatory fixtures or appliances, each of which is formed of a material such as a stainless steel or a Monel™ metal which is resistant to corrosion in the salt water or salt atmosphere. Most and preferably all of the fixtures, with the exception of shower stalls, will be bulkhead mounted and have no deck connections to impede cleaning of the deck. Similarly, other components such as countertops, privacy panels and doors will also be bulkhead or overhead mounted, and preferably will include stiffeners to prevent noise generation or physical damage induced by rolling, pitching or vibration of the vessel or sea-positioned structure.

A critical element in this invention is a novel coating for head decks, bulkheads and overheads which has multiple layers, all adhered into a moisture impervious continuous medium. The two principal layers are an outer porcelain, ceramic or terrazzo layer, which forms the bearing or working surface of the coating, and a membrane layer, which is a continuous sheet of a rubber, polymeric elastomer or a fiber-reinforced mat. This membrane, which itself must be moisture impervious, serves to prevent moisture from penetrating the coating to the metal surface of the deck, bulkhead or overhead even if the surface porcelain ceramic tile or terrazzo may become damaged or disrupted. The porcelain ceramic/terrazzo surface layer and the membrane are adhered to each other by salt-water-environment-resistance adhesives, preferably various epoxy adhesives. The coating is also adhered to the underlying metal surface of the deck, bulkhead or overhead by a similar adhesive, again preferably an epoxy resin. A primer layer is applied to the metal surface and is a part of the coating of this invention, and will constitute the layer in contact with the metal surface, to create and maintain a strong bond with the metal surface, notwithstanding the presence of rust or similar surface contamination of the metal.

Therefore, in a broad embodiment, the invention herein is of a head structure for use in a salt water environment and having an interior defined by a deck, a bulkhead and an overhead, at least one of the deck, bulkhead and overhead having a metal surface exposed within interior of the head structure and which is susceptible to corrosion in the salt water environment, which structure comprises at least one lavatory fixture being mounted on the bulkhead and having plumbing connections therethrough; and a coating covering a corrosion-susceptible metal surface, which coating comprises a porcelain, ceramic or terrazzo layer disposed adjacent to but spaced apart from said metal surface, a moisture-impervious membrane disposed between said porcelain, ceramic or terrazzo layer and said metal surface, and adhesive bonding said porcelain, ceramic or terrazzo layer to said membrane and said membrane to said corrosion-susceptible metal surface; whereby the coating prevents moisture within the interior of the head from contact with the metal surface of the deck, bulkhead or overhead and thereby prevents the metal surface from becoming corroded in the salt water environment.

In yet another broad environment, the invention is of a coating for adherence to and covering of corrosion-susceptible metal surface of the head structure of the present invention, which coating comprises a porcelain, ceramic or terrazzo layer disposed adjacent to but spaced apart from said metal surface, a moisture-impervious membrane disposed between said porcelain, ceramic or terrazzo layer and said metal surface, and adhesive bonding said porcelain, ceramic or terrazzo layer to said membrane and said membrane to said corrosion-susceptible metal surface; whereby the coating prevents moisture within the head from contact with the metal surface and thereby prevents the metal surface from becoming corroded in the salt water environment.

In both embodiments, the membrane within the coating comprises a continuous sheet of moisture-impervious rubber, polymeric elastomer or fiber-reinforced resin.

Other embodiments, components and properties of the head structure and the coating which is applied to the deck, bulkheads and overhead of such head structure will become evident from the description below.

DESCRIPTION AND PREFERRED EMBODIMENTS

Figure 1:
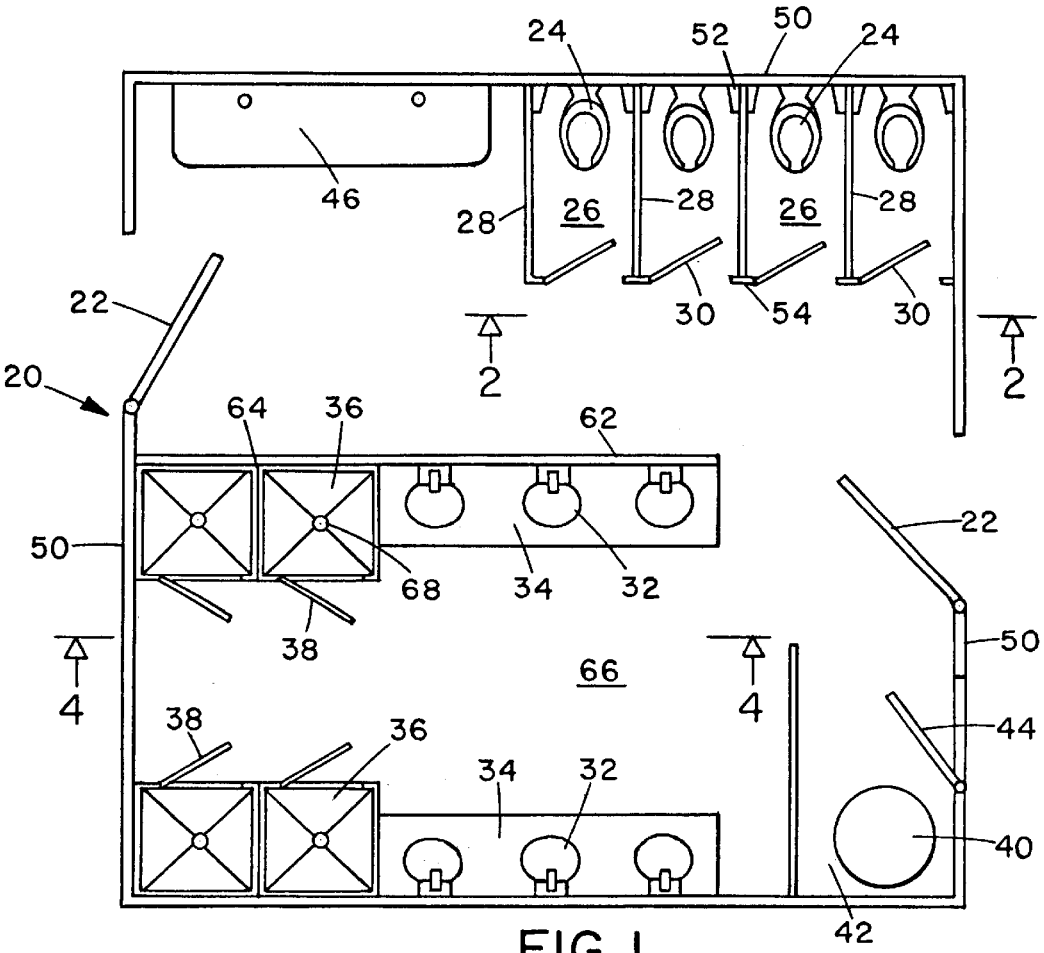
FIG. 1 is a plan view of a typical head installation.

The present invention is best understood by reference to the Figures. Considering first FIGS. 1 and 2, a typical layout for a head 20 of this invention is shown in overhead plan view. Access to the head 20 from adjacent companionways may be through hatches or doors 22. The head has one or more commodes 24 each of which is positioned within a privacy stall 26 having bulkhead-mounted privacy panel 28 on either side with a privacy door 30. Also within the head 20 are one or more wash basins 32, also bulkhead mounted, with adjacent counter tops 34. A third area of the head contains one or more shower stalls 36, also with privacy doors 38. A water heater 40 is conveniently positioned in an adjacent compartment 42 which can be closed by a door 44.

In recent years, many ship's crews in both the naval and commercial fleets have begun to include both men and women. The heads of this invention can be configured for men only, for women only or to accommodate both men and women. For instance, in the head illustrated in FIG. 1 the component 46 may be a large utility wash basin for heavy cleaning, which would be applicable in any configuration of the head, or if the head is to be used exclusively by men, component 46 could be a trough urinal.

Figure 2:
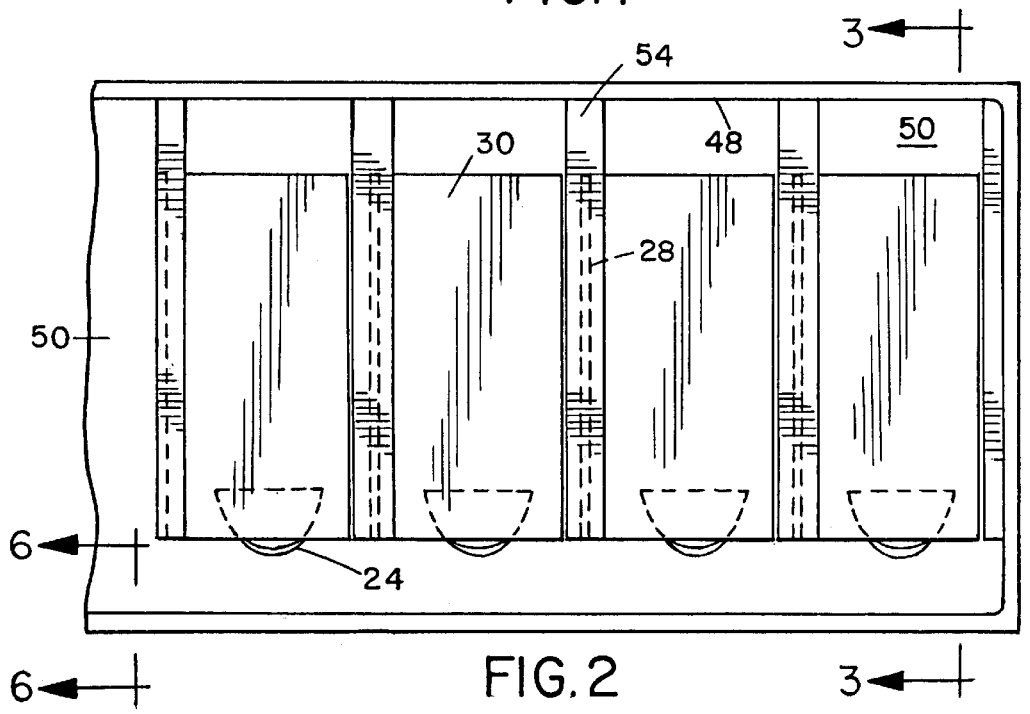
FIG. 2 is an enlarged view taken in the direction of arrows 2—2 in FIG. 1.
Figure 3:
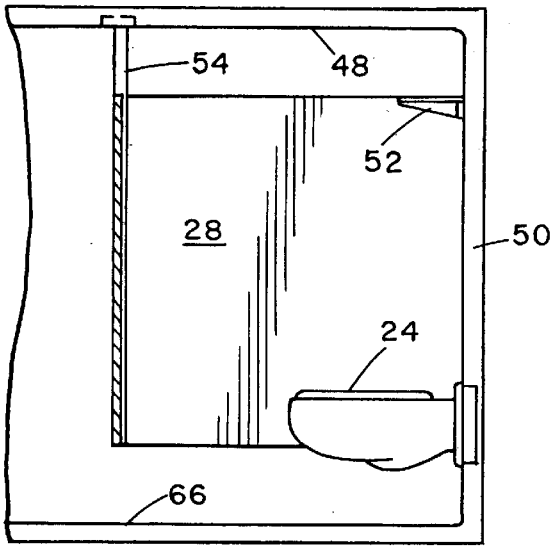
FIG. 3 is a sectional view taken on line 3—3 of FIG. 2.

FIGS. 2 and 3 illustrate an important feature of the present head invention, which is that to the greatest extent possible all fixtures, appliances, counters and other structures are suspended from the overhead 48 or attached to a bulkhead 50 or 62. In the configuration illustrated, each of the commode stall privacy panels 28 is mounted at one end to the bulkhead 50 by a stiffening bracket 52. The other end of the privacy panel 28 is attached to a fascia panel 54 which reaches from the bottom of the privacy panel 28 to above the panel to a connection with the overhead 48. If desired a similar stiffening bracket 52 may be used at the top of the fascia panel 54 to provide additional rigidity to the privacy panel 28. All of the various fixtures, appliances, panels and other head complements are intended to be secured to bulkheads or to the overhead with a very firm connection, such that even severe rolling, pitching or vibration of a vessel or structure will not cause the panels, etc. to move, rattle, or otherwise cause a noise or mechanical problem. Similarly, the privacy doors 30 are preferably fitted with spring loaded stiff hinges, so that when a door 30 is open and the vessel is moving, the door will not swing freely and make noise or become damaged. Alternatively, the privacy doors 30 can be spring-loaded so that they remain closed at all times except when someone opens the door to pass into or out of a stall 26. This is less preferred, however, since it is considered more advantageous for a vacant stall to have a partially opened door so that a person entering the head will be able to tell immediately which stalls are occupied and which are vacant.

Mounting of commodes 24 and other fixtures and appliances to bulkheads 50 or 62 will be by means of conventional bulkhead fittings which include plumbing connections to hot and cold water supply lines and waste disposal lines within or behind the bulkheads. The use of such connections is not affected by the present invention, except that the bulkhead must be covered with the coating of this invention (to be described below) before the plumbing connection and the commodes or other fixtures are mounted. This is to insure that all working surfaces of the bulkhead will be covered with the protective coating and that mounting a commode or other fixture will not compromise the coating and expose the bulkhead metal to moisture and corrosion.

Figure 4:
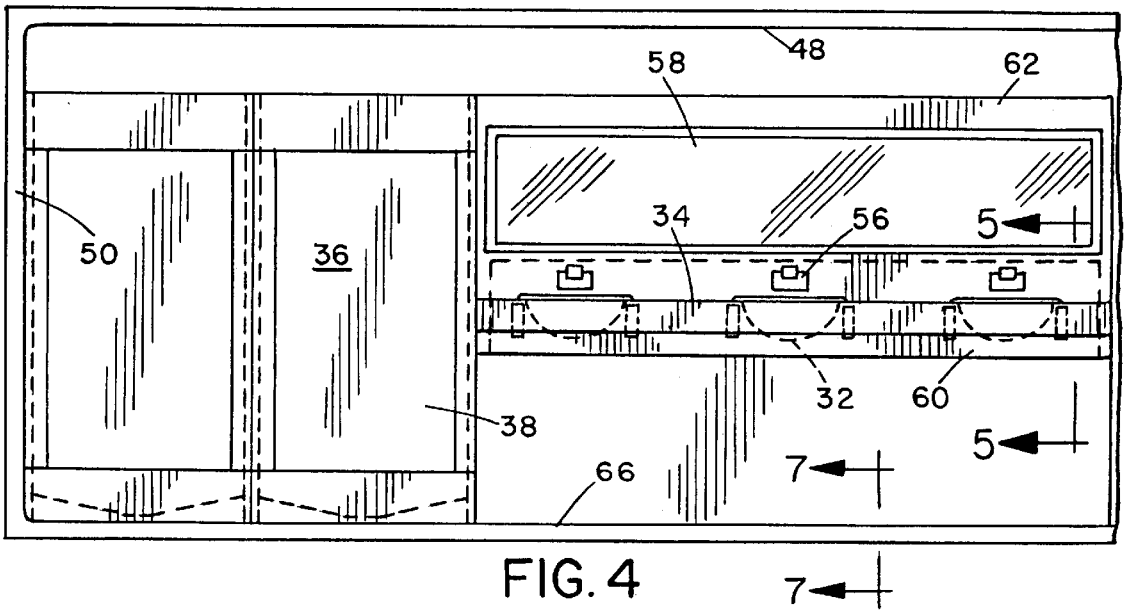
FIG. 4 is an enlarged view taken in the direction of arrows 4—4 in FIG. 1.
Figure 5:
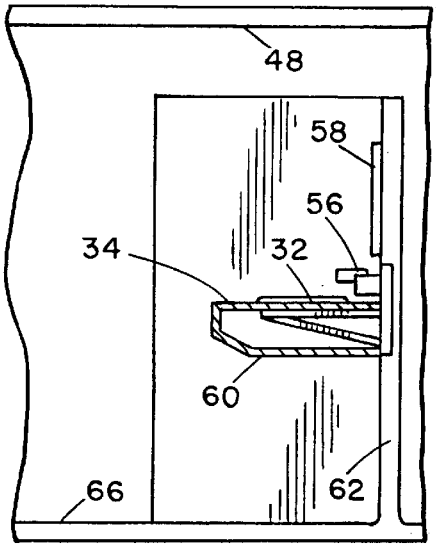
FIG. 5 is a sectional view taken on line 5—5 in FIG. 4.

FIGS. 4 and 5 illustrate the same principle in the current head invention with respect to wash basins and adjacent counter tops. As with the commodes 24, the wash basins 32 are bulkhead mounted. (In the configuration illustrated, the mounting is to intermediate partial bulkhead 62 rather than the compartment bulkhead 50.) As with the commodes, plumbing connections between the basins 32 and the bulkhead 62 are conventional. Here also it is intended that the bulkhead 62 be coated prior to placement of the basins, counter 34 and plumbing fittings.

It will be seen best in FIG. 5 that the counter 34 meets with a lower shield 60 so that counter 34 and shield 60 together form an enclosure which prevents dirt from reaching the underside of the counter 34 or the wash basins 32. The shield 60 is preferably connected to counter 34 by simple screws, so that it may be removed for repair or replacement of a basin 32 or a plumbing fixture. Mounted above each basin 34 is a water faucet console 56 with conventional hot and cold water controls. Also mounted above the basins 34 is a full-length mirror 58. While individual mirrors could be fitted above each individual basin, it is preferred to have a full-length mirror since it is more easily cleaned and presents less joints or edges for collection of dirt or moisture.

FIGS. 1 and 4 also illustrate the shower stalls 36. Due to their function, the shower stalls 36 with their separating partition walls 64 must be installed on the deck 66. However, it is essential that they be installed only after the deck coating has been applied. The single shower drain 68 in the floor of the shower 36 must be fully sealed so that no moisture from the interior of the shower will leak from the drain 68 to the metal deck beneath the coating at the drain opening in the deck. In addition, it is desirable to cove the coating up from the deck and along the lower fascia of each shower stall so that water used to clean the deck 66 will not penetrate under the shower stalls.

It is intended that to the extent possible all fixtures, appliances, panels. Doors and other components will be made of stainless steel, preferably 316, 316LN or 347 stabilized stainless steel, or of a Monel™ metal. Other materials such as corrosion resistance ceramics, other steel alloys or other metal alloys may be used if desired, but are likely to be more expensive. Panels, counters, and doors are preferably made with a honeycomb interior between the stainless steel metal exterior sheets, to provide stiffness and strength without adding excessive weight. It is also important, as illustrated in FIG. 5, that all panels, countertops, doors, faucet consoles, etc. be sealed along each edge, either with a rubber, epoxy or similar seal (as would be used at the joints of counter 34 and shield 60) or by welding, so that dirt and moisture cannot get into the interior of any structure. As noted above, it is a principle of this present invention that the entire head should be cleanable with wash-and-wipe methods, which require that joints, edges, recesses and the like be sealed so that any dirt remains on the surface of the component and does not penetrate into the component's interior.

It will also be advantageous to direct the routing of the hot and cold water supply lines and waste disposal drain lines such that, by inclusion of properly located shut-off valves and bypasses, each of the three principal sectors of the head (the commodes, wash basins and showers) can be functionally isolated from the others, so that an individual sector can be isolated and shut down, such as for repair, upgrading, relocation of fixtures, or other major work, without affecting the operation of the other sectors. Currently many prior art heads do not permit isolation of any portion, so that required work on one sector necessarily removes the entire head from service until the work is completed. In heads of this invention, however, the ability to isolate individual sectors permits some continued service for a head even while the isolated sector is worked on.

It will be evident from the above description that while the head of this invention contains the same type of fixtures, appliances, etc. that are normally found in current heads, their arrangement, mounting and structural sealing are significantly different here from what has been the prior art practice.

Figure 6:
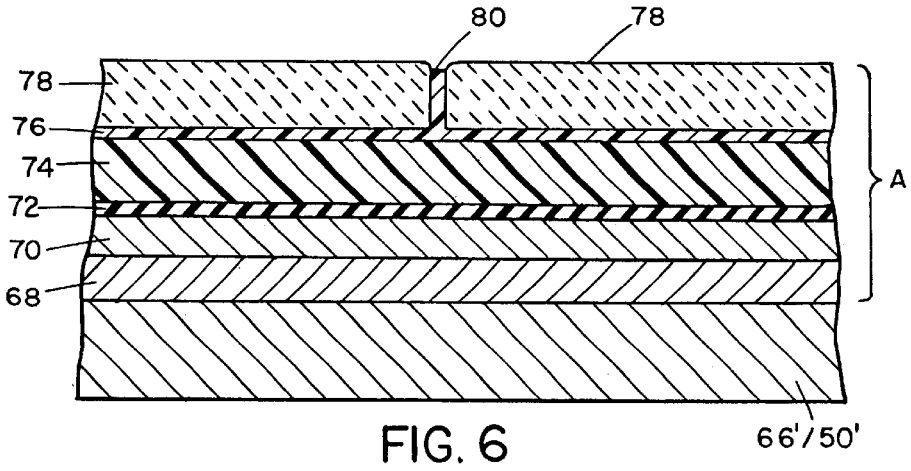
FIG. 6 is a greatly enlarged view taken on line 6—6 of FIG. 2, showing the various layers of the protective coating applied to a deck or bulkhead metal surface.
Figure 7:
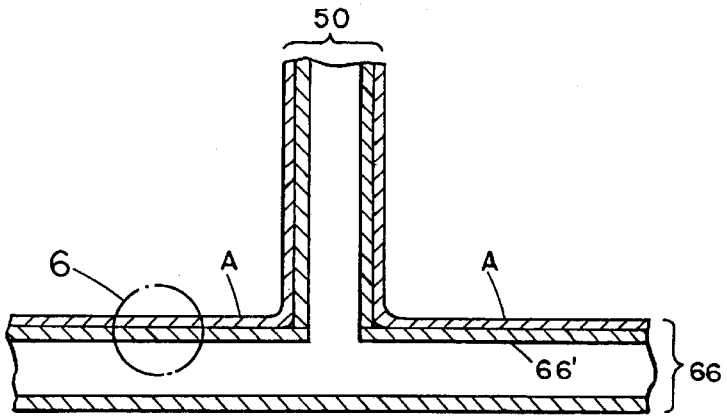
FIG. 7 is an enlarged sectional view taken on line 7—7 of FIG. 4.
Figure 8:
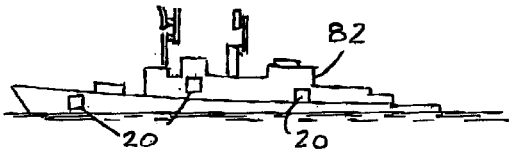
FIG. 8 is a schematic diagram of a sea-going vessel illustrating typical placements therein of heads of this invention.
Figure 9:
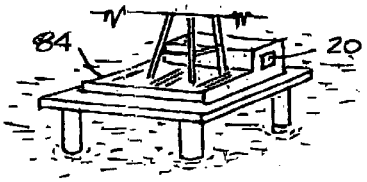
FIG. 9 is a schematic diagram of a sea-positioned structure, exemplified as a drilling rig, illustrating typical placement therein of a head of this invention.

The most important part of the present head invention is illustrated in FIGS. 6 and 7. (While FIG. 6, as noted, is taken on line 6—6 in FIG. 2, it is also convenient to consider that FIG. 6 can be represented as any portion of the combination of bulkhead or deck metal to which the coating of the present invention has been applied, such as the circled area shown in dotted lines and designated 6 in FIG. 7.) As FIG. 7 indicates, the designation 66 is used generally in the Figures to indicate the deck as a single structure, including the coating applied to it, and the designation 50 is similarly used to indicate a bulkhead as a whole, including the applied coating, for the purpose of general discussion herein. However, for the purposes of discussion of the aspects of the invention illustrated in FIGS. 6 and 7, the deck or bulkhead metal itself will be designated 50' or 66' and the coating as a whole, including all of its individual layers, will be designated A.

As is evident from FIG. 6, the coating A actually consists of several individual layers, each of which is important to the coating's functions of both protecting the deck or bulkhead metal and providing an easily cleaned, durable and attractive surface to simplify head maintenance. The specific layers used will differ slightly, depending on whether the coating is applied to the deck or a bulkhead (or the overhead 48, since sealing and protection of all surfaces forming the head compartment is intended). The differences will be described below, in conjunction with FIGS. 6 and 7. The descriptions below and the specific materials identified as examples are based on various tests conducted by the inventors, including reconstruction of several prior art heads on U.S. Navy harbor crew quarters vessels moored in San Diego Bay, Calif.

Disposed outwardly from deck metal 66' are two layers of epoxy resin designated respectively 68 and 70. The layer 68 adjacent to the deck metal is formed of a rust penetrating surface tolerant sealer, preferably an epoxy resin, having low viscosity and requiring a low film thickness for performance. The function of the layer 68 is to penetrate through any rust on the surface of the deck metal 66' and adhere strongly to the metal 66' to form a solid and continuous layer to which subsequent layers can be adhered. It may be of any polymeric material which provides rust penetration, strong adhesion to the metal and to the next outward layer 70, and which is stable under the conditions of moisture, motion, temperature, etc. normally encountered aboard a vessel, drilling rig, etc. at sea or in an equivalent salt water environment. Most preferred are the epoxy resins, but other materials having equivalent properties are intended to be within the scope of this invention. An example of a rust penetrating sealer which has proved quite successful is a two-part epoxy available commercially from Ameron Protective Coatings Group of Brea, California, under the trade designation "Devoe Pre-Prime 167." It is recommended that all deck, overhead and bulkhead surfaces (unless new) be abrasive blasted prior to application of coatings of this invention. However, it is recognized that abrasive blasting will not remove all rust which may have been present, and that in some cases sand blasting will not be conducted. Therefore, the rust penetrating sealer 68 is used to provide a primed metal surface for the adhesion of the subsequent layers, in order to insure good adhesion of the complete coating to the deck, bulkhead or overhead metal.

The next outward layer, 70, is an adhesive polymer, also preferably an epoxy resin, which will adhere strongly to both the primer layer 68 and to the next layer, the membrane 72. The layer 72 therefore provides the solid foundation which the membrane needs to provide protection of the metal against any moisture which may penetrate the subsequent outer layers. The layer 70 may be any suitable polymer which, like the primer layer 68, provides the adhesive properties required along with stability in the salt water environment. Most preferred are epoxy resins, a suitable one of which is a multi-purpose epoxy coating also commercially available from the Ameron Protective Coatings Group under the trade designation "Devoe Bar-Rust™ 235."

The membrane 72 is a critical part of the invention. It may be made of a rubber, an polymeric elastomer, or a fiber-reinforced mat, but it must be fully moisture impervious and repellent, so that no moisture can pass through the membrane as long as it is physically intact. The membrane will be on the order of ⅛ to ¼ in. (3.1 to 6.3 mm) thick. Any seams formed when the membrane is laid down will be sealed by adhesive or by welding the adjacent edges of membrane sections together to form a moisture impervious sheet which extends over the entire coated area of the deck, bulkheads and overhead. The membrane functions to block moisture which may penetrate the outward adhesive and ceramic layers from reaching the underlying steel of the deck, bulkheads and overhead, even if the outer layers of the coating are damaged. Any type of rubber may be used, as well as any type of rubber-like polymeric elastomer, as long as it is impervious to moisture and does not age with time and can retain its physical integrity despite the motions, vibration, etc. to which the head structure will be subject at sea or in any other salt water environment. Similarly, a resin mat reinforced with fiber such as glass fiber or ceramic fiber may be used, as long as it meets the same requirements. Specifically, not only the resin matrix but also the fiber reinforcement must be impervious to moisture and capable of withstanding the adverse environmental conditions. Typical suitable membranes are commercially available under the tradenames "Dex-O-Tex Elasta Flake" , "Hydro-guard 2000" and "Merkote BFP".

Outwardly of the membrane 72 is underlayment layer 74. The purpose of this layer is to serve as underlayment for the actual working surface of the coating, especially for deck coatings. Preferably this layer will be made of a filled polymeric based terrazzo. This layer functions as underlayment of porcelain or ceramic tiles for deck surfaces, but also serves as essentially the surface layer for the non-deck areas of bulkheads and overheads. While as with the layers 68 and 70 there are a number of different polymeric materials which can be used, the epoxy resin based materials are preferred because of the suitability of epoxy resins as both adhesives and as surface layers, and because of the ability of epoxy resins to function well under the adverse environmental conditions of salt water and salt air. The terrazzo structure of the layer 74 usually is formed of the polymer being filled with particulate mineral materials, such as ground marble or quartz sand. The terrazzo is troweled onto the surface of the membrane to a thickness of about ¼ to ⅜ in. (6.3 to 9.5 mm). The terrazzo may have loose lakes of rocks or minerals placed on top of it, with the loose materials being sealing into the terrazzo by use of a highly abrasion resistant, clear surface sealing material. A suitable terrazzo material is commercially available from Empar Corporation of Santa Fe Springs, Calif., under the trade designation "Sta-Crete Underlayment System."

Finally, the top two layers for deck coats are mortar/grout layer 76 and porcelain or ceramic tile 78. The mortar/grout layer 76 may be any grout or mortar material which will bond the porcelain or ceramic tile 78 to the underlayment layer 74 and will also withstand the rigors of daily foot traffic and daily washings with strong cleaners and disinfectants of the type needed on board ship, as well as the motion, temperature and salt environment of a seagoing vessel or sea-positioned structure. It especially must resist breaking, disintegration, powdering, and similar loss of physical integrity, since it will usually be exposed at the surface of the deck coating. Since it will usually be visible to the eye, the mortar/grout layer 76 must also, resist staining, fading or discoloring, and must be impervious to moisture. Epoxy resins are again the preferred material for the mortar/grout 76. Suitable materials include two similar two-component epoxy resins also commercially available from Empar Corporation under the trade designations "Sta-Crete SS1240" and "Sta-Crete SS1241."

The porcelain or ceramic tile 78 may be any porcelain or ceramic tile which, like mortar/grout layer 76, will withstand the rigors of daily foot traffic and daily washings with strong cleaners and disinfectants of the type needed on board ship, as well as the motion, temperature and salt environment of a seagoing vessel or sea-positioned structure. The tile must further, however, provide a decorative surface to afford a pleasing appearance to those using the head. Also like the mortar/grout layer 76, it must resist staining, fading or discoloring, and must be impervious to moisture. It is recognized that porcelain or ceramic tile, while strong, is also susceptible to breakage if struck with sufficient impact. One further advantage of the present coating system with respect to decks is that a broken tile or tiles may be readily taken up and replaced with new tiles, without any significant disruption or compromise of the remainder of the coating system, especially the integrity of the membrane 74. To the extent that the original tiles have retained their appearance, color, and other visual properties, the replacement tiles may be reasonably indistinguishable from the original tiles and therefore the deck coating may be repaired without detracting from its desirable appearance. A porcelain or ceramic tile which has proved satisfactory is available commercially from Dal-tile Corporation of Dallas, Tex. under the trade designation "Daltile Keystones."

In many cases the mortar/grout layer 76 will not only underlie the porcelain or ceramic tiles 78, it will also serve as the grout between the edges of the tiles 76 as shown in FIG. 6 at 80. It is possible, however, to use a different grout between the tiles 78 than is used for the rest of the mortar/grout layer 76, so that the grout material in between the tiles at 80 will be entirely or partially different from the mortar/grout material in layer 76. It is more convenient, however, to use the same material both at 76 and at 80.

It has been found that construction of a new head of the present invention, or conversion of an old head to a head of this invention, requires no more construction time than has been normal for construction or rehabilitation of the prior art heads. The installation of the multilayer coatings in the present heads do usually require more time than is needed for the single layer deck and coatings of the prior art. However, this is offset by installation of the bulkhead-mounted fixtures, panels, etc., which can be installed more quickly in most cases than the deck mounted components of the prior art heads.

The heads of this invention, using the novel coatings described to protect deck, bulkhead and overhead metal structures, provide attractiveness, ease of maintenance and long service life. Crews find them easier and faster to clean, and the users find them to be cleaner and maintain that cleanliness longer than prior art heads, and therefore more pleasant to use.

It will be evident that there are numerous embodiments of this invention which, while not expressly described above, are clearly within the scope and spirit of this invention. The above description is therefore to be considered exemplary only, and the actual scope of the invention is to be determined from the appended claims.

We claim:

1. A head structure for use in a salt water environment and having an interior defined by a deck, a bulkhead and an overhead, at least one of said deck, bulkhead and overhead having a metal surface exposed within the interior of said head structure and which is susceptible to corrosion in said salt water environment, which structure comprises:

at least one lavatory fixture being mounted on said bulkhead and having plumbing connections therethrough; and a coating adhered directly to said metal surface which is corrosion-susceptible, which coating comprises:

a porcelain or ceramic layer;

a moisture-impervious membrane;

a first adhesive layer coextensive with an interface between said terrazzo layer and one side of said membrane and bonding said terrazzo layer and said membrane together;

a rust penetrating surface tolerant sealer layer, adhered to said metal surface and penetrating rust thereon; and a second adhesive layer coextensive with an interface between said membrane on the side opposite to the said one side and said rust penetrating surface tolerant sealer layer and bonding said membrane and said rust penetrating surface tolerant sealer layer together;

whereby said coating prevents moisture within said interior of said head structure from contact with said metal surface of said deck, bulkhead or overhead and thereby prevents said metal surface from becoming corroded in said salt water environment.

2. A head structure as in claim 1, further comprising said fixture being formed of a material which is resistant to corrosion in said salt water environment.

3. A head structure as in claim 2 further comprising a plurality of said fixtures, at least one of which is disposed within a privacy stall defined by at least one panel.

4. A head structure as in claim 3 wherein each said fixture and panel is mounted on said bulkhead or said overhead, but has no attachment to said deck.

5. A head structure as in claim 4 wherein each said fixture comprises a commode or wash basin.

6. A head structure as in claim 5 further comprising at least one additional fixture which is mounted on said deck.

7. A head structure as in claim 6 wherein said additional fixture comprises a shower stall.

8. A head structure as in claim 1 wherein said porcelain or ceramic layer is exposed to said interior of said head structure, and further wherein said coating is applied to said metal surface of said deck, whereby said porcelain or ceramic layer is becomes the working surface of said deck which bears foot traffic of persons within said head structure.

9. A head structure as in claim 1 wherein said membrane within said coating comprises a continuous sheet of moisture-impervious rubber, polymeric elastomer or fiber-reinforced resin.

10. A head structure as in claim 1 wherein said second adhesive layer comprises at least one epoxy resin.

11. A head structure as in claim 1 incorporated into a sea-going vessel.

12. A head structure as in claim 11 wherein said sea-going vessel comprises a naval vessel or a commercial vessel.

13. A head structure as in claim 1 incorporated into a sea-positioned structure.

14. A head structure as in claim 13 wherein said sea-positioned structure comprises a drilling rig.

15. A coating adapted to be used for adherence to and covering of a corrosion-susceptible metal surface of a maritime head structure, which coating comprises;

a porcelain or ceramic layer;

a moisture impervious membrane;

a first adhesive layer coextensive with an interface between said terrazzo layer and said one side of membrane and disposed between said terrzzo layer and said membrane and to effect bonding thereof;

a rust penetrating surface tolerant sealer layer disposed on and adhered to said metal surface to penetrate rust thereon; and a second adhesive layer coextensive with an interface between said membrane on the side opposite to the said one side and said rust penetrating surface tolerant sealer layer and disposed between said membrane and said rust penetrating surface tolerant sealer layer and to effect bonding thereof;

whereby said coating prevents moisture within said head structure from contact with said metal surface and thereby prevents said metal surface from becoming corroded in said salt water environment.

16. A coating as in claim 15 wherein said membrane within said coating comprises a continuous sheet of moisture-impervious rubber, polymeric elastomer or fiber-reinforced resin.

* * * * *

UNITED STATES PATENT AND TRADEMARK OFFICE

CERTIFICATE OF CORRECTION

PATENT NO. : 6,247,195 B1
DATED : June 19, 2001
INVENTOR(S) : O'Brien, Owen G.

It is certified that error appears in the above-identified patent and that said Letters Patent is hereby corrected as shown below:

Column 9,
Line 16, insert -- a terrazzo layer bonded to said procelain or ceramic layer; --.
Line 22, before "adhered" and after "layer", delete ",".
Line 26, after "to", delete "the".

Column 10,
Line 5, before "becomes" and after "layer", delete "is".
Line 23, change ";" to -- : --.
Line 24, insert -- a terrazzo layer bonded to said porcelain or ceramic layer; --.
Line 25, change "moisture impervious" to -- moisture - impervious --.
Line 27, change "said one side of" to -- one side of said --.
Line 34, before "said" and after "to", delete "the".

Signed and Sealed this

Tenth Day of September, 2002

*Attest:*

*Attesting Officer*

JAMES E. ROGAN
*Director of the United States Patent and Trademark Office*